United States Patent [19]

Mechalas

[11] Patent Number: 4,648,432

[45] Date of Patent: Mar. 10, 1987

[54] VACUUM APPARATUS FOR FILLING BAGS WITH PARTICULATE MATERIAL INCLUDING DUST COLLECTOR AND RECYCLING OF COLLECTED MATERIAL

[76] Inventor: Emmanuel Mechalas, 2830 Townway, Danville, Ill. 61832

[21] Appl. No.: 754,856

[22] Filed: Jul. 12, 1985

[51] Int. Cl.[4] ..... B65B 1/26; B65B 1/18; B65B 3/17

[52] U.S. Cl. ..... 141/68; 141/10; 141/83; 141/12; 141/65; 141/73; 141/93; 141/5; 141/114; 141/315

[58] Field of Search ..... 141/10, 65, 68, 114, 141/286, 59, 5-8, 12, 59, 66, 67, 37, 44, 93, 45, 69, 70, 71, 73, 313-316, 83, 392; 177/190-198

[56] References Cited

U.S. PATENT DOCUMENTS

| | | | |
|---|---|---|---|
| 2,720,375 | 10/1955 | Carter | 141/68 X |
| 2,765,816 | 10/1956 | Carter | 141/65 |
| 2,799,465 | 7/1957 | Carter | 141/65 X |
| 2,964,070 | 12/1960 | Linhardt | 141/7 |
| 3,102,561 | 9/1963 | Lau | 141/286 |
| 3,193,035 | 7/1965 | Ferro | 177/192 X |
| 3,209,845 | 10/1965 | De Hollander | 177/192 X |
| 3,219,072 | 11/1965 | Lau | 141/286 |
| 3,542,091 | 10/1970 | Carter | 141/65 |
| 3,586,067 | 6/1971 | Jorgenson | 141/12 |
| 3,785,410 | 1/1974 | Carter | 141/10 |
| 3,788,368 | 1/1974 | Geng et al. | 141/67 |
| 3,942,561 | 3/1976 | Stoeffler | 141/67 |
| 4,212,331 | 7/1980 | Benatar | 141/67 |
| 4,219,054 | 8/1980 | Carter et al. | 141/10 |
| 4,311,173 | 1/1982 | Sailors, Jr. | 141/68 |

FOREIGN PATENT DOCUMENTS

| | | | |
|---|---|---|---|
| 544402 | 1/1956 | Belgium | 141/68 |
| 704831 | 4/1966 | Italy | 141/12 |
| 2032380 | 5/1980 | United Kingdom | 141/68 |

*Primary Examiner*—James E. Byrant, III
*Assistant Examiner*—Ernest G. Cusick
*Attorney, Agent, or Firm*—Neal J. Mosley

[57] ABSTRACT

An automatic bag filling machine employs a reduced pressure or a vacuum within a bag enclosing shroud to draw powdered material into either valved bags or vapor barrier bags in a series of increments to fill the bags with a relatively compacted powder. The shroud has movable liner assembly for adjustably enclosing bags of various size. A novel filling spout and a vapor barrier spout carrier by the shroud each have an expandable boot member to seal the mouth of the bag on the spout to preclude seepage of powdered material from the bag interior during filling. A filter tank connected to the machine reduces the discharge of powdered material into the surrounding atmosphere, and allows waste material to be reclaimed. Valves for controlling vacuum imparted to the shroud chamber, venting the bag interior, powdered material flow, and relief to atmospheric pressure of the shroud interior, are operated in proper sequence to fill the bag.

21 Claims, 17 Drawing Figures

VACUUM APPARATUS FOR FILLING BAGS WITH PARTICULATE MATERIAL INCLUDING DUST COLLECTOR AND RECYCLING OF COLLECTED MATERIAL

BACKGROUND OF THE INVENTION

1. Field of the Invention

This invention relates to apparatus for dispensing powders and other finely divided material into receptacles such as valved bags, and more particularly to an automatic bag filling machine which uses vacuum within a bag enclosing shroud to draw finely divided material into the bag in a series of increments to fill the bag more compactly.

2. Brief Description of the Prior Art

Through the years, a variety of different filling methods and machines for filling receptacles have been developed and have to varying degrees met with satisfactory acceptance in the receptacle filling industry. Although a number of acceptable proposals and machines have been developed for the handling of ordinary particulate materials, it is recognized that special problems are encountered in connection with the handling and dispensing of very finely divided or powdered materials.

With the very finely divided materials as referred to above, there is a tendency for the material to become fluffy by reason of air entrained in the powder. Whereas such entrained air may serve a useful purpose in facilitating freer flow of the material through the dispensing machine to the receptacle being filled, it is a distinct drawback from the standpoint of achieving the desired degree of material compaction within the filled receptacle. Removing this entrained air to compact the material presents a real problem in filling the receptacle with these powdered materials.

In the past, one suggested solution to compacting finely divided material by freeing it of air which becomes entrained between the powder particles has been to subject the receptacle during filling to rapid vibration. Under this filling method, as the particles tend to settle down, material is added to the receptacle until the receptacle contains the desired weight of material for its particular size. Whereas this filling method has been and is presently being used, it has a distinct disadvantage in that it may require a period of several hours of continuous receptacle vibration and repeated material additions to fill a drum with the desired weight of powdered material as for example in the case where silica gel or carbon black is being dispensed. In comparison with this length of time required for vibratory filling, the present invention can achieve the same degree of material compacting in filling the same size receptacle in a matter of minutes.

As a further problem encountered in the handling and dispensing of very finely divided powders, the characteristic of such powders to become dispensed in the atmosphere surrounding the filling machine and thereafter settle on the machine parts and areas adjacent the machine has been recognized as a definite problem in the development of filling machines. Accordingly, it is of the utmost importance that a filling machine for use in handling such finely divided powders to be constructed to reduce to a minimum the escape of powders either from the machine mechanism itself or from the receptacle as it is being filled.

The construction of the filling machine of the instant invention and its mode of operation have been developed to possess the required characteristics for the handling of finely divided powders. As a further advantage of the filling machine described in detail hereinafter, its automatic operation, commencing from the time of introduction of the bag to be filled into the shroud and continuing through the completion of the bag filling cycle, contributes to reducing the chance for escape of powdered material into the surrounding atmosphere.

The bag filling apparatus of the present invention is a substantial improvement over U.S. Pat. Nos. 2,756,906, 2,765,816, and 2,799,465 issued to C. F. Carter and manufactured by Modern Machine Shop, Inc. of Danville, Illinois. The present invention involves a new apparatus which has a number of specific improved features.

SUMMARY OF THE INVENTION

One object of the present invention is to provide an apparatus and method for filling receptacles with finely divided materials or powders in a minimum amount of time in the filling operation and which produces a high degree of compaction of the material dispensed into the receptacle.

A further object of this invention is to provide an apparatus and method for filling receptacles under vacuum in a series of increments wherein the vacuum which is effective to draw the material into the receptacle and simultaneously assist in withdrawing entrained air from the material mass.

Still another object of this invention to provide a bag filling machine having a shroud with a movable liner to provide an adjustable chamber for enclosing the bag being filled to subject the bag exterior to a reduced pressure and further having a filling spout with a vapor barrier seal element actuatable to retain the bag on the spout so as to preclude seepage of powdered materal from the bag interior during filling.

Yet another object of the instant invention is to provide a filling machine having a shroud suspended from a scale mechanism and providing an adjustable chamber for receiving the bags being filled, together with valves for controlling vacuum imparted to the shroud chamber, venting the bag interior, powdered material flow, and relief to atmospheric pressure of the shroud interior, all actuatable in proper sequence to effect incremental filling of the bag.

A still further object of the invention is to provide a filling machine in combination with a filter tank supporting a method for collecting and reclaiming any dust or fill material which may otherwise escape from, or cause harm to the system equipment.

Other objects of the invention will become apparent from time to time throughout the specification and claims as hereinafter related.

The above noted objects and other objects of the invention are accomplished by an automatic bag filling machine which employs a reduced pressure or vacuum within a bag enclosing shroud to draw finely divided material into valve type bags and vapor barrier type bags in a series of increments to produce highly compacted material as the final product. The shroud has movable liner assembly for adjustably enclosing bags of various size. A novel filling spout and a vapor barrier spout carried by the shroud each have an expandable boot member to seal the mouth of the bag on the spout so as to preclude seepage of powdered material from the bag interior during filling. A filter tank connected to the machine contributes to reducing the chance for escape of powdered material into the surrounding atmosphere, and allows waste material to be reclaimed. Valves for controlling vacuum imparted to the shroud chamber, venting the bag interior, powdered material flow, and relief to atmospheric pressure of the shroud interior, are actuatable in proper sequence to effect incremental filling of the bag.

DESCRIPTION OF THE PREFERRED EMBODIMENT

Figure 2:
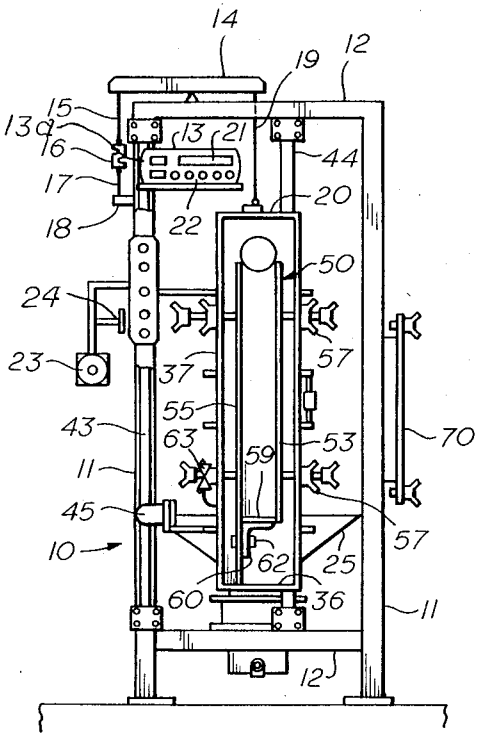
FIG. 2 is a view in side elevation of the machine of FIG. 1, with the shroud member being shown in cross section.
Figure 1:
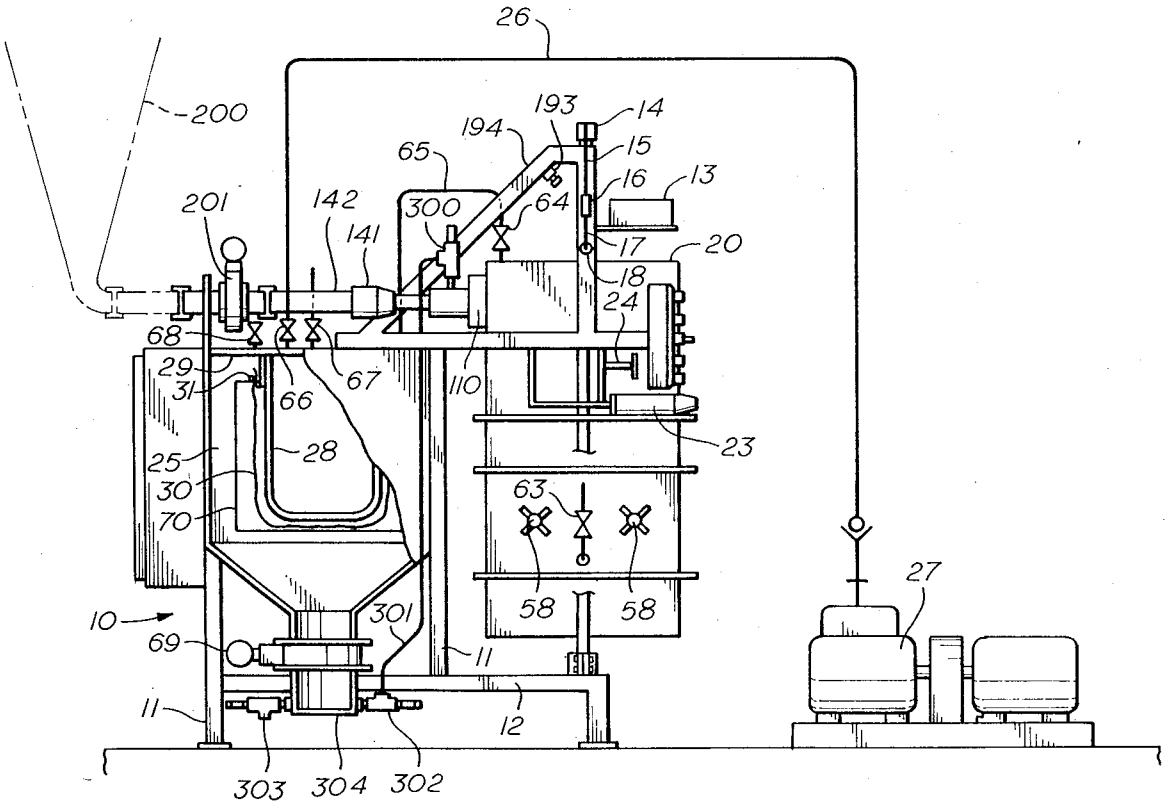
FIG. 1 is a view in front elevation of a bag filling machine incorporating the features of the instant invention.
Figure 4:
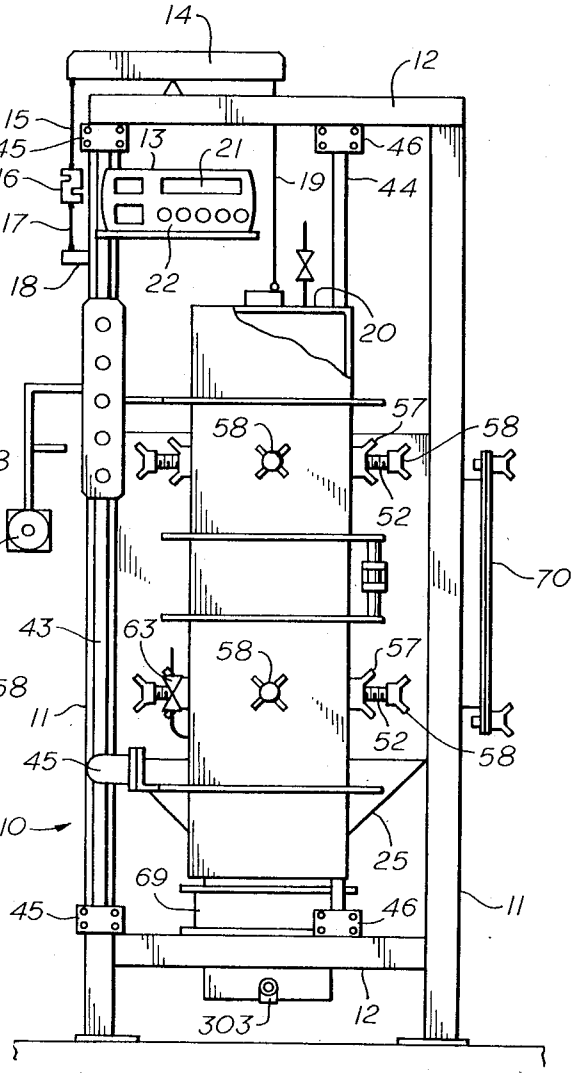
FIG. 4 is an enlarged front elevation of the bag filling machine.

Referring the drawings and specifically to FIGS. 1 to 4, there is shown a bag filling machine which includes a support frame 10 having upright legs 11 interconnected by a plurality of transverse members 12. An electronic scale mechanism 13, for weighing, is suspended from one of the upper transverse members 12.

This scale mechanism includes a beam 14 pivotally mounted on an upper transverse member 12. A cable 15 extends downwardly from one end of the beam 14 and is attached to the top end of a load cell 16. Another cable 17 attached to the bottom of the load cell 16 extends downwardly therefrom to be secured to a rod 18 which extends outwardly from the vertical leg 11.

A cable 19 attached to the opposite end of the beam 14 extends downwardly therefrom and is attached to the top of a generally rectangular shroud member 20. The electronic scale mechanism 13 is interconnected by connection 13*a* with the load cell 16 and includes a visual display 21 and various control knobs 22 for calibrating the weight of the shroud 20 during various operations responsive to different weights of material dispensed into the bags being filled.

A tubular bag-inflating horn 23 mounted on the frame 10 extends forwardly to the side of the shroud 20 to connect to an air supply provided with a valve 24. The front of the horn 23 is tapered to receive the mouth of a bag for inflating the bag prior to placement into the shroud to permit the bag to be filled in the shroud.

A filter tank 25 is attached to the frame structure and is connected between the vacuum lines 26 and 65 between the vacuum pump 27 and the shroud 20. The filter tank 25 serves to protect the vacuum pump 27 and to collect and reclaim any dust or fill material which may escape from the processing equipment. The filter tank 25 is a hopper-shaped enclosure having a filter basket 28 of open construction extending downward from the tank top wall 29. A filter bag 30 of fiberous material is inserted over the basket 28 and retained thereon by a clamp 31.

As shown in FIGS. 3 to 7, the shroud 20 comprises two segments 32 and 33 which are hinged together. One segment 32 comprises a rear wall 34, top wall 35, bottom wall 36, and side wall 37. The other segment 33 comprises a front wall 38 and side wall 39. A series of vertically-spaced, flat, rectangular hinge ears 40 and 41 on the outer surfaces of the shroud segments extend outwardly therefrom to pivotally join the segments 32 and 33 together. An elastomeric seal strip 42 (FIG. 7) is attached to the inner periphery of the front wall 38 and side wall 39 to seal against the edges of the side wall 37, the top and bottom walls 35 and 36, and the rear wall 34 when the two segments are closed.

A pair of vertical shafts 43 and 44 connected to hinge ears 40 and 41 restrict lateral sway of the shroud 20 while permitting free unrestricted longitudinal movement of the shroud under yielding conditions of the scale mechanism. The ends of the shafts 43 and 44 extend beyond the top and bottom walls 35 and 36 of the shroud 20. The extended ends of shaft 43 are slidably received through ball bushing pillow blocks 45 extending outwardly from the hinge ears 40 midway between the longitudinal sides of the rear wall 34 and are secured to the frame 10.

Shaft 44 is mounted vertically on the hinge ears 41 diagonally adjacent the juncture of the front wall 38 and the side wall 39 to form a pivot point for the segment 33. The extended ends of shaft 44 are slidably received through ball bushing pillow blocks 46 which are secured to the frame 10. Thus, segment 33 pivots about the longitudinal axis of the shaft 44 and the shroud 20 is allowed limited up and down movement, as the scale mechanism responds to the material dispensed into the bag being filled, by the shafts 43 and 44 sliding vertically in the pillow blocks 45 and 46.

The hinge ears 41, midway of the length of the front wall 38, extend rearwardly of the shaft 44 and have a vertical rod 47 connected therebetween to form an arm 48. A pneumatic actuator 49 is supported on the shroud and has its actuating rod pivotally connected to the arm 48 with the cylinder of the actuator pivotally supported on the side wall 37. Selective application of pressurized fluid to the actuator 49, will open or close the shroud 20.

Figure 3:
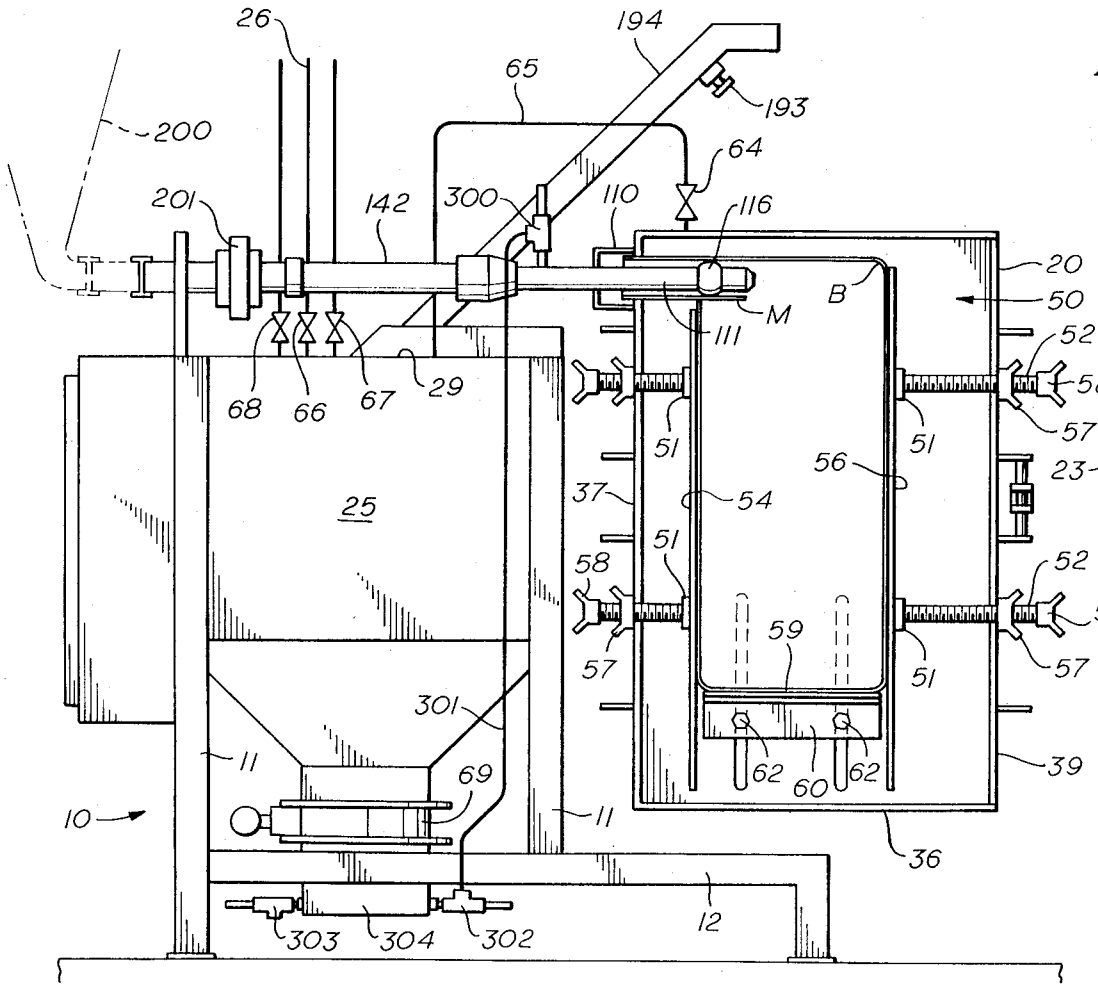
FIG. 3 is an enlarged side elevation, partially in cross section, of the bag filling machine.
Figure 6:
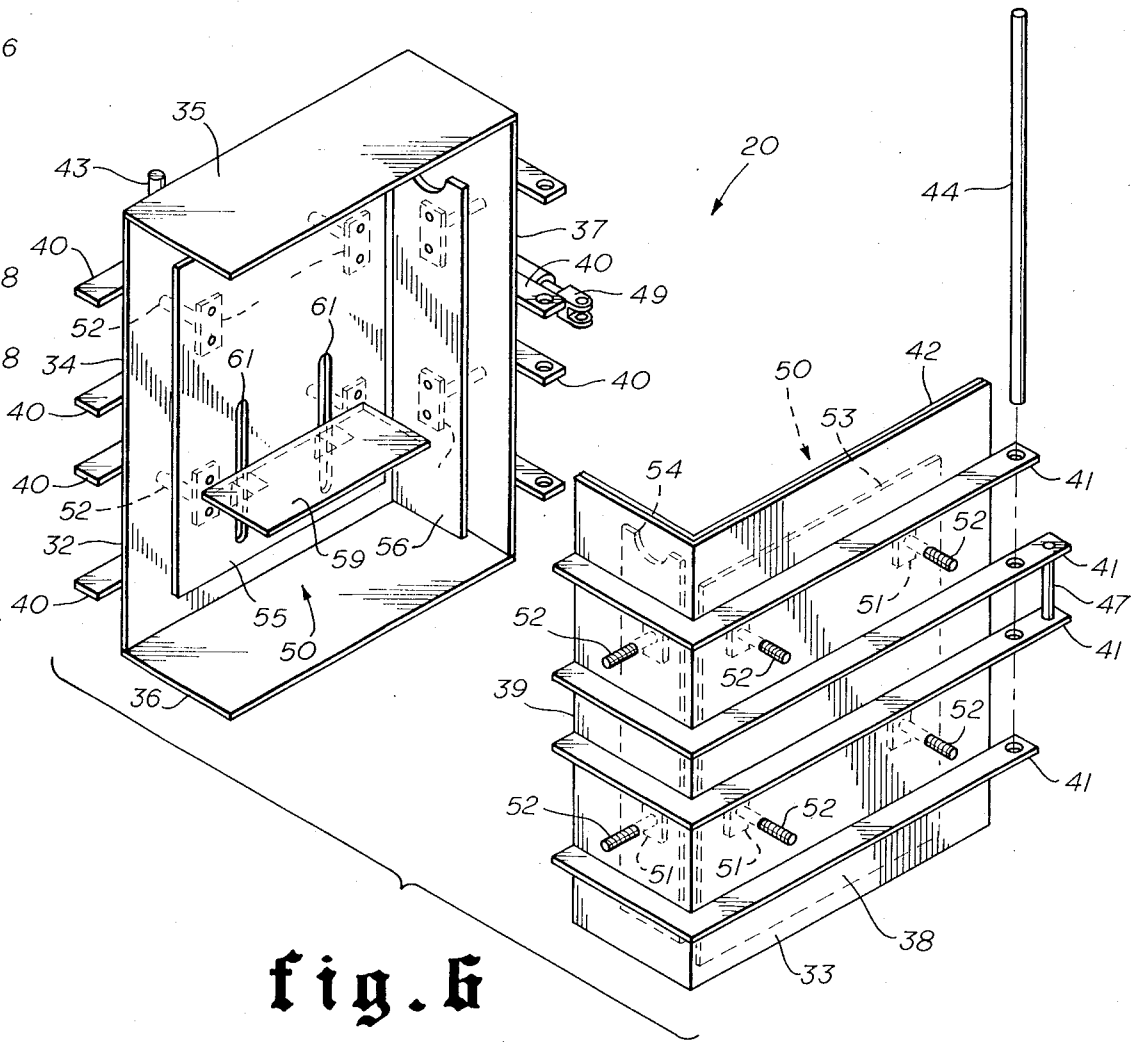
FIG. 6 is an exploded isometric view of the shroud member.
Figure 5:
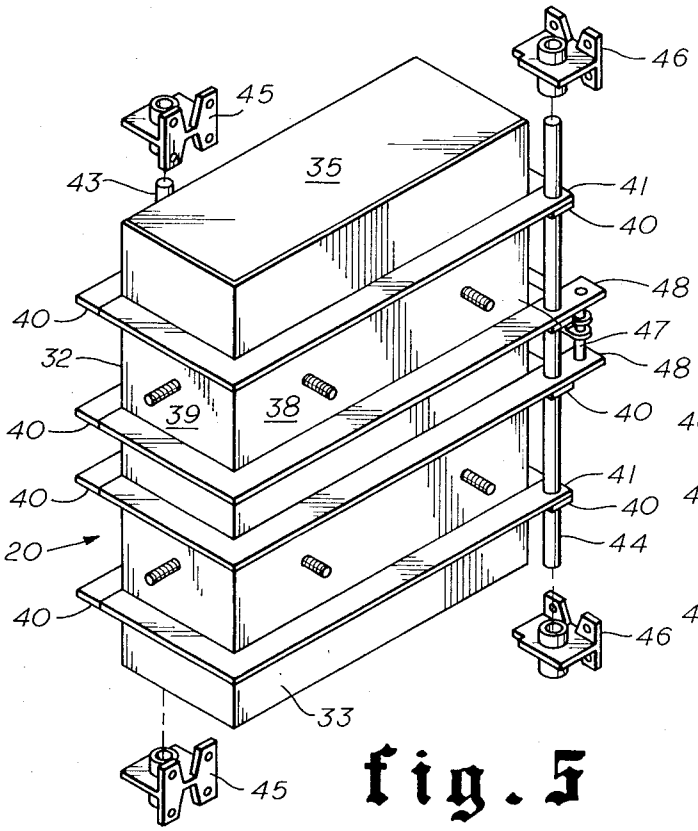
FIG. 5 is an isometric view of the shroud member.
Figure 7:
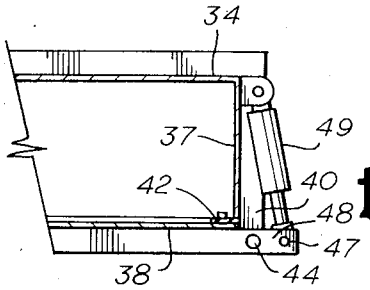
FIG. 7 is a top detail view of a portion of the shroud member.

As seen in FIGS. 3, 5 and 6, an adjustable liner assembly 50 is positioned within the shroud 20 and comprises four opposed parallel rectangular plate members of suitable material such as aluminum plate. Swivel blocks 51 having a threaded rod 52 with one end rotatably secured therein and the opposed end extending outwardly therefrom are fastened to the outer surface of the plate members.

The front plate 53 is disposed interior of the front wall 38 and the side plate 54 is disposed interior of the side wall 39. Similarly, the rear plate 55 and side plate 56 are disposed interior of the rear wall 34 and the side wall 37 respectively. Each of the extended ends of the threaded rods 52 are threaded through locking knobs 57 rotatably attached to the outer surface of the shroud walls, and adjusting knobs 58 are provided on the protruding ends. In this manner, turning the adjusting knobs 58 will move the plates relative to one another and turning the locking knobs 57 will secure the plates against further movement.

A bottom plate 59 is attached to an inverted L-shaped bracket 60 which is slidably connected for vertical movement within a pair of spaced parallel slots 61 in the rear plate 55 and extends perpendicularly outward therefrom. A pair of bolts 62 lock the bracket 60 and plate 59 into the desired height above the bottom wall 36. Thus, it is a simple matter to appropriately vary the relative positions of the plates of the liner assembly 50 to accomodate bags of various sizes and proportions.

A relief valve 63 is mounted in the rear wall of the shroud 20 to control communication of the shroud interior with atmospheric pressure. A vacuum control valve 64 is mounted in the top wall of the shroud 20 and controls communication of the shroud with the filter tank 25 through conduit 65.

A vacuum valve 66 and a backwash valve 67 are mounted on the top wall 29 of the filter tank 25. The vacuum valve 66 establishes communication between the vacuum pump 27 and the interior of the filter tank 25 inside the filter bag 30. The backwash valve 67 communicates the interior of the filter tank 25 with a backwash air supply.

An air inlet valve 68 disposed on the top wall of the tank 25 allows air to enter the tank exterior of the filter bag 30. A butterfly valve 69 coupled with a valve actuator are disposed at the bottom of the tapered portion of the tank 25. An access door 70 on the side of the tank 25 allows access to the basket 28 for installing and removing filter bags therefrom.

Figures 8, 10, 11, 13, 14:
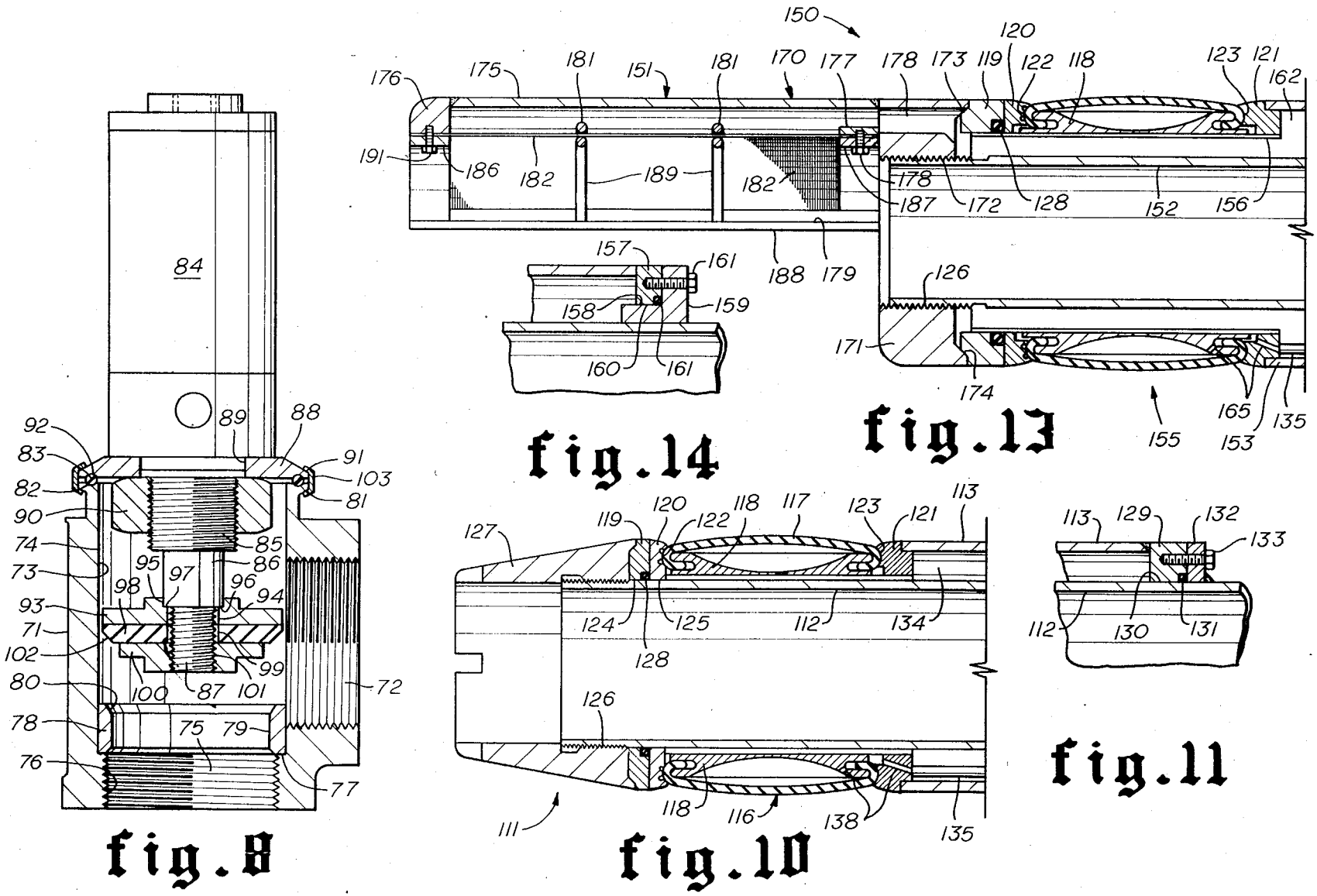
FIG. 8 is a central section of a valve member used in the filling machine.
FIG. 10 is an enlarged detailed sectional view of the end portion of the filling spout of FIG. 9.
FIG. 11 is an enlarged detailed sectional view of the rear portion of the filling spout of FIG. 9.
FIG. 13 is an enlarged detailed sectional view of the end portion of the vapor barrier spout of FIG. 12.
FIG. 14 is an enlarged detailed sectional view of the rear portion of the vapor barrier spout of FIG. 12.

FIG. 8 shows a preferred valve for use in the system where automatic valves are used, etc., valves 64, 66, 67, and 68. Such a valve comprises a tee shaped body member 71 having a threaded side inlet/outlet 72 and a through bore 73 extending downwardly from the top portion 74 to terminate at an internally threaded bottom inlet/outlet 75. The threads 76 of the inlet/outlet 75 are of smaller diameter than the bore 73 to form a flat annular shoulder 77 therebetween. A cylindrical valve seat member 78 having a bore 78 rests within the bore 73 on the shoulder 77. The bore 79 at the top of the seat is chamferred to provide an angular sealing surface 80.

The top portion 74 of the valve body 71 is machined to form an annular inclined clamping surface 81. The top surface is provided with a circular groove 82 which receives a gasket 83. An air cylinder 84 having a threaded collar portion 85 and a piston rod 86 extending therefrom is attached to the valve body 71. The extended end of the piston rod 86 is provided with threads 87.

A flat cylindrical mounting disk 88 having a central bore 89 is retained on the air cylinder collar 85 by threading a nut 90 onto the threaded portion of the collar 85. The disk 88 has an annular inclined clamping surface 91 opposed to the clamping surface of the valve body and its bottom surface is provided with a mating groove 92 to receive the upper portion of the gasket 83.

A circular retainer member 93 having a central bore 94 and a counter bore 95 forming a shoulder 96 therebetween is received on the piston rod 86 with the shoulder 96 resting on a mating shoulder 97 on the piston rod. A flat circular elastomeric seal member 98 having a central bore 99 is received on the piston rod 86 below the retainer member 93.

A retaining nut 100 having a central threaded bore 101 is threaded onto the piston 86 to secure the seal 98 between it and the retainer member 93. The outer periphery of the seal 98 is larger in diameter than the retaining nut 100 and is formed to have a circumferential angular sealing surface 102 to mate mith the sealing surface 80 of the valve seat 78.

The air cylinder 84 is releasably attached to the valve body 71 by means of a conventional quick release clamp 103 which co-acts with the angular clampimg surfaces 81 and 91 to bias the mounting disk 88 and the valve body 71 against the gasket 83.

Figure 9:
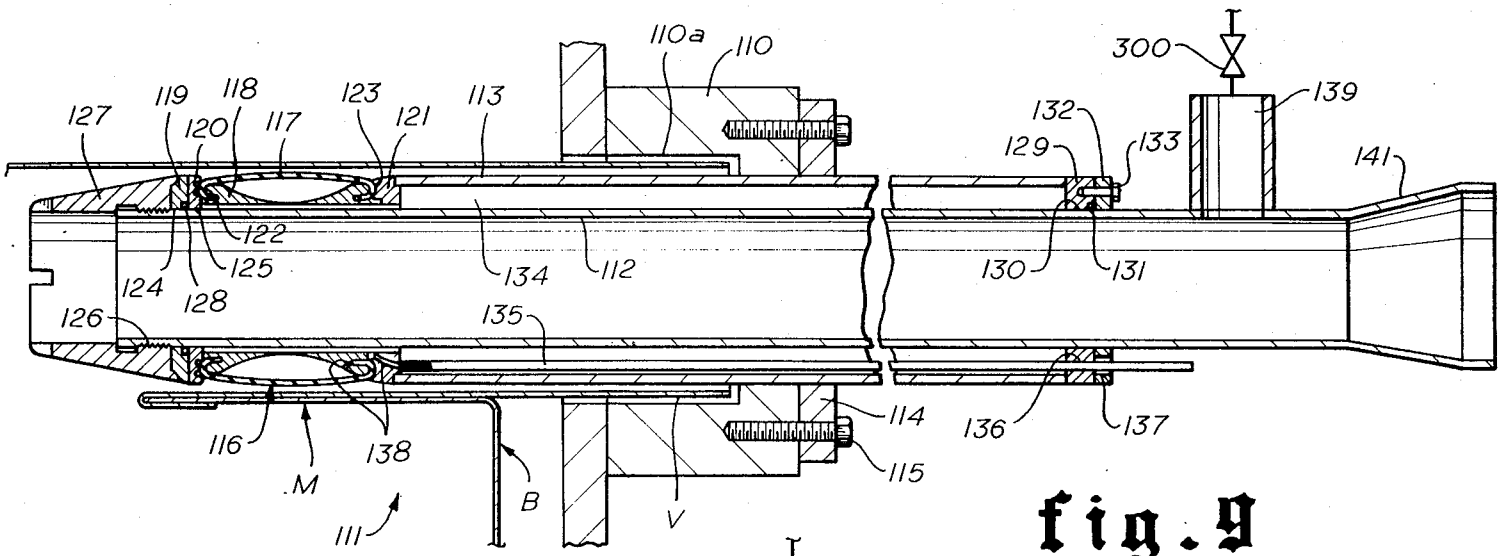
FIG. 9 is a detailed sectional view of the filling spout of the bag filling apparatus.

As shown in FIGS. 3 and 9, the shroud 20 is provided adjacent the rear upper corner thereof with a housing 110 which serves to mount the filling spout 111 that extends inwardly of the shroud interior. The housing 110 is provided with a cylndrical cavity **110*a*** to receive the valve portion V of the bag mouth M.

It will be appreciated that the bag to be filled when positioned for filling will have the filling spout 111 extending through the bag mouth M. Referring now to FIGS. 9, 10, and 11, the spout 111 consists of an inner tubular member 112 and a concentric outer tubular member 113 having a flange 114 bolted to housing 110 by bolts 115.

An inflatable seal element or boot 116 is carried on the periphery of the inner tubular member 112. The boot 116 comprises a flexible resilient sleeve 117 enclosing a ring sleeve 118 which serves to support the resilient sleeve and hold it in position on the filling spout. A pair of spacer rings 119 and 120 are disposed at the forward end of the boot and a single spacer ring 121 is disposed at the rearward end of the boot 116. The spacer rings 120 and 121 are provided with inwardly curved shoulders 122 and 123 which fit the curved forward and rearward ends of the boot ring sleeve 118 to capture and retain the sides of the resilient sleeve 117 therebetween.

The forward pair of spacer rings 119 and 120 are provided with central bores 124 and 125 which are received on the outer periphery of the inner tubular member 112. The forward end of the inner tubular member 112 extends beyond the rings 119 and 120 and is provided with exteior threads 126. The resilient sleeve 117, ring sleeve 118, and spacer rings 119, 120, and 121 are biased against each other and retained between the inner tubular member 112 and the outer tubular member 113 by a spout tip 127 threaded onto the extended forward end of the inner tubular member 112. An O-ring seal 128 is provided between the ring 119 and the outer periphery of the inner tubular member 112.

A flat cylindrical end cap 129 (FIG. 11) having a central bore 130 encloses the rearward end of the outer tubular member 113. The inner tubular member 112 extends through the bore 130 and an O-ring seal 131 at the rearward end of the bore provides a seal between the end cap 129 and the outer periphery of the inner tubular member 112.

The inner tubular member 112 has a flange 132 welded thereon which is bolted to the end cap 129 by bolts 133. With the flange 132 bolted to the end cap 129 and the spout tip 127 tightened, the O-rings 128 and 131 are compressed forming a sealed chamber 134 between the inner tubular member 112 and the outer tubular member 113.

A small conduit or boot tube 135 attached at its forward end to the ring 121 extends rearwardly therefrom through bores 136 and 137 in the end cap 129 and flange 132 respectively to be connected to a source of pressurized fluid. An air passageway 138 extends through the rings 121 and 118 to establish communication between the boot tube 135 and the interior of the resilient sleeve 117 for the admission of pressurized fluid thereinto through the tube 135. The regulation and control of the admission of pressurized fluid is explained hereinafter.

Inlet 139 is provided on the inner tubular member 112. An adapter 141 is provided on the rearward end of the inner tubular member 112 for connecting the spout to the material fill conduit 142. The inlet 139 is connected to a valve 300.

Figure 12:
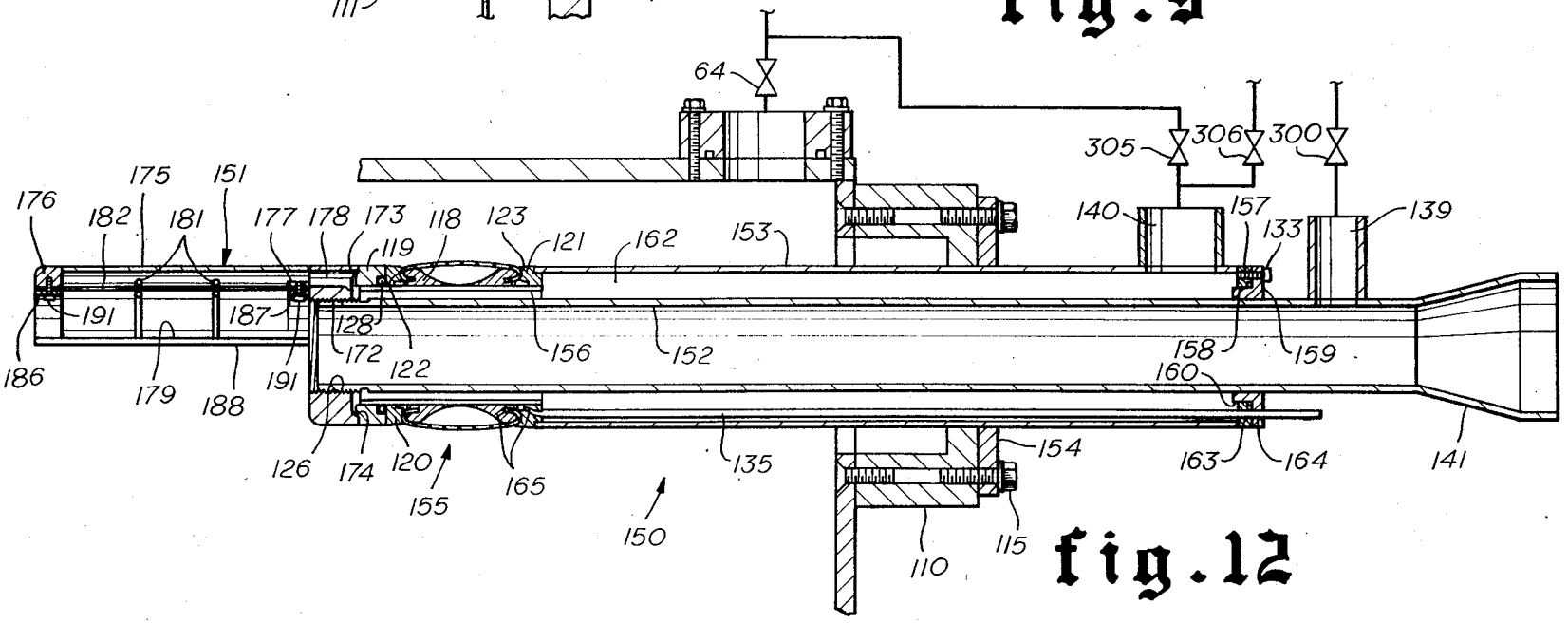
FIG. 12 is a detailed sectional view of the vapor barrier spout and part of the enclosing shroud.
Figure 16:
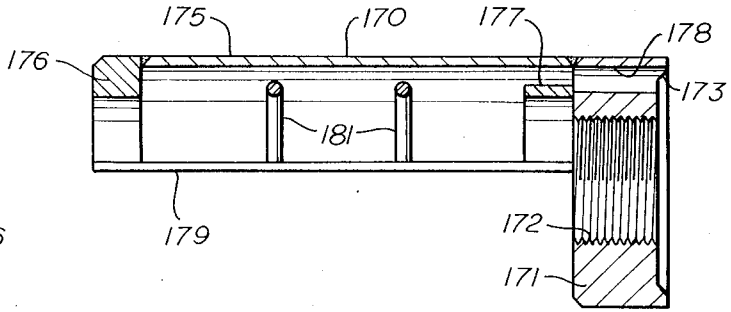
FIG. 16 is a side elevation in cross section of a component of the vapor barrier nozzle.
Figure 17:
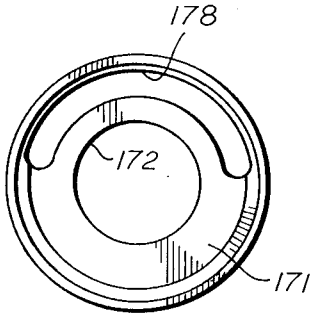
FIG. 17 is an end elevation view of a component of the vapor barrier nozzle.
Figure 15:
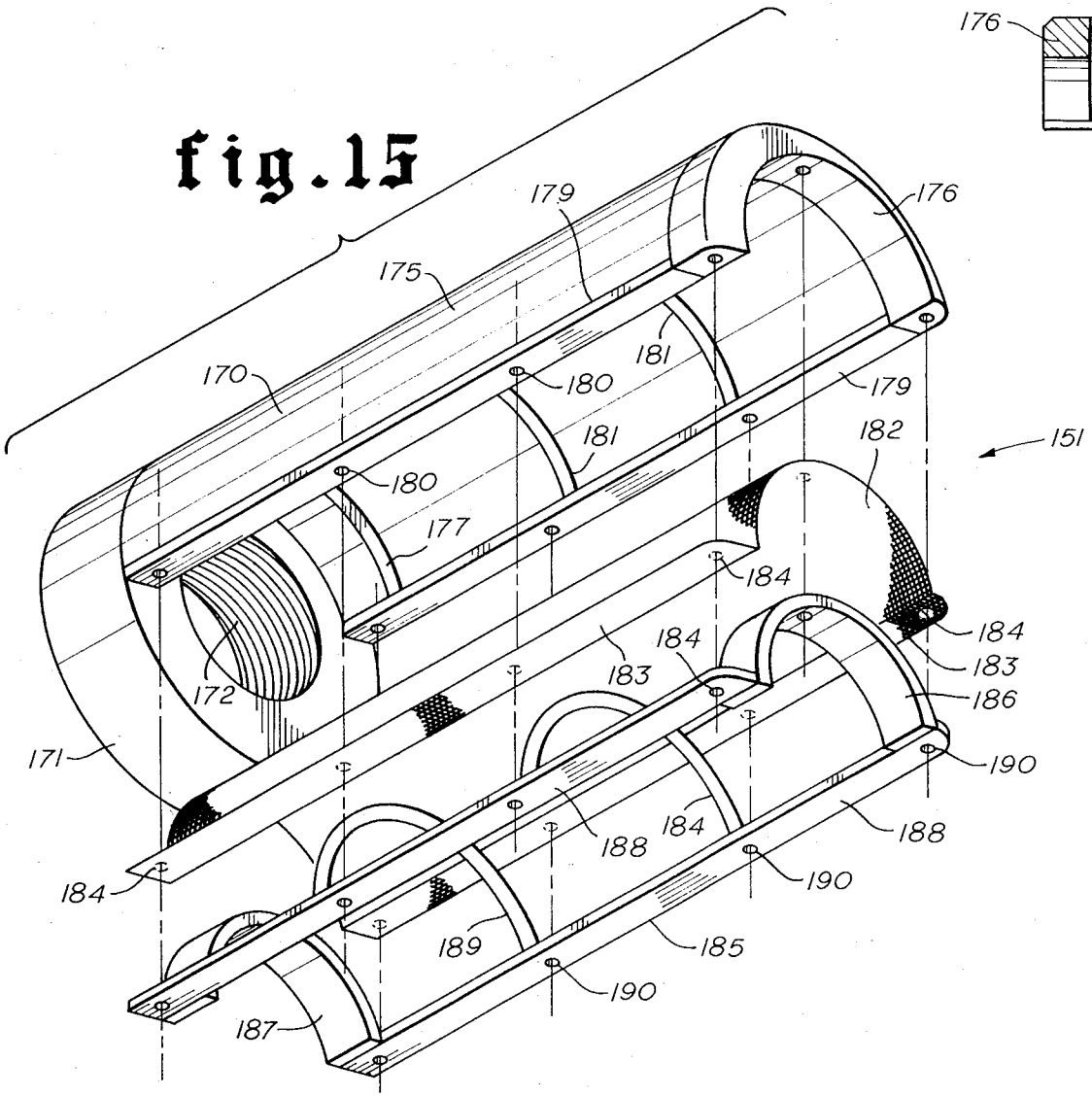
FIG. 15 is an exploded isometric view of the vapor barrier nozzle of the bag filling apparatus.

FIGS. 12, 13, and 14 show a vapor barrier spout 150 having a vapor barrier nozzle 151 which is used in filling bags of non-porous material of "vapor barrier" bags having a plastic lining. The vapor barrier spout 150 consists of an inner tubular member 152 and a concentric outer tubular member 153 having a flange 154 bolted to housing 110 by bolts 115. An inflatable seal element or boot 155 is carried on the periphery of the outer tubular member 153. The boot 155 is similar in construction to the boot of FIG. 9 except that the central bores of spacer rings 119, 120 and 121 are received on the outer periphery of a cylindrical inner sleeve 156 instead of on the periphery of the inner tubular member.

The same description and numerals of reference used in FIG. 9 are applied to the same components of FIGS. 12, 13, and 14 to void repetition. The forward end of the inner tubular member 152 extends beyond the rings 119 and 120 and is provided with threads 126. The resilient sleeve 117, ring sleeve 118, and spacer rings 119, 120, and 121 are biased against each other and retained between the inner sleeve 156 and the outer tubular member 153 by the vapor barrier nozzle 151 (described hereinafter) threaded onto the extended forward end of the inner tubular member 152. An O-ring seal 128 is provided between ring 119 and the outer periphery of the inner sleeve 156.

A flat cylindrical end cap 157 having a central bore 158 encloses the rearward end of the outer tubular member 153. The inner tubular member 152 has a flange 159 welded thereon which is bolted to the end cap 157 by bolts 133. The flange 159 is provided with a reduced diameter shoulder 160. The shoulder 160 extends through the bore 158 and an O-ring seal 161 at the rearward end of the bore provides a seal between the end cap 157 and the outer periphery of the shoulder 160. With the flange 159 bolted to end cap 157 and the vapor barrier nozzle 151 tightened, the O-rings 128 and 161 are compressed forming a sealed chamber 162 between the inner tubular member 152 and the outer tubular member 153.

A small conduit or boot tube 135 attached at its forward end to the ring 121 extends rearwardly therefrom through bores 163 and 164 in the end cap 157 and flange 159 respectively to be connected to a source of pressurized fluid. An air passageway 165 extends through the rings 118 and 151 to establish communication between the boot tube 135 and the interior of the resilient sleeve 117 for the admission of pressurized fluid thereto through the tube 135. The regulation and control of the admission of pressurized fluid is explained hereinafter.

Inlets 139 and 140 are provided in the outer tubular member 153 and inner tubular member 152. An adapter 141 is provided on the rearward end of the inner tubular member for connecting the spout to the material fill conduit 142. Inlet 139 is connected to a valve 300, an inlet 140 is connected to a value 305. Valve 306 is interposed in the line between the inlet 140 and the valve 305.

Referring now to FIGS. 12 through 17, the vapor barrier nozzle 151 will be explained. The nozzle 151 comprises a hollow semi-cylindrical member 170, one end of which forms a cylindrical ring 171 having a concentric central threaded bore 172 which is received on the threaded end of the inner tubular member 152. An angular inwardly extended clamping surface 173 is provided on the inner end of the ring 171 for contacting a mating angular surface 174 on the spacer ring 119. A semi-cylindrical side wall 175 having semi-cylindrical rings 176 and 177 at each end is attached to the outer end of the ring 171 and extends outwardly therefrom. The rings 176 and 177 are of smaller internal diameter than the side wall 175 to form a curved surface spaced inwardly of the side wall. An arcuate passageway 178 spaced radially outward of the bore 172 extends through the ring 171 to establish communication between the chamber 162 formed between the inner and outer tubular members 152 and 153.

A pair of opposed flat rectangular flanges 179 extend outwardly from and longitudinally along the edges of side wall 175 between the rings 176 and 177. A series of longitudinally spaced apart threaded holes 180 are disposed on the flanges 179. A series of semi-circular rods 181 are welded in a longitudinally spaced apart position to the inner surface of the side wall 175.

A wire mesh screen 182 is contoured to conform to the inner diameters of the rings 176, 177, and the rods 181, and is provided with opposed outwardly projecting longitudinally extending flange portions 183 which mate with the flange 179. Holes 184 are provided in the flange portions 183 to match the holes 180 of the flanges 179.

A retaining bracket 185 comprises an open frame structure having semi-circular rings 186 and 187 at each end connected by a pair of parallel flat rectangular flanges 188 extending longitudinally therebetween. A series of semicircular rods 189 are welded to the flanges 188 in a longitudinally spaced apart position in concentric alignment with the rods 181. The rings 176, 177, and rods 189 are smaller in diameter than the rings and rods of the semi-cylindrical member 170. A series of holes 190 are provided in the flanges 188 in alignment with the holes 180 in the flanges 179.

To assemble the vapor barrier nozzle 151, the screen 182 is placed into the semi-cylindrical member 170 to rest on the rings 176, 177 and rods 181, and the bracket 185 is placed over the screen. Screws 191 are placed into the appropriate holes and tightened thereby securely clamping the screen 182 between the mating rods, rings, and flanges. In this manner, the interior of the bag is in communication with atmosphere through the nozzle 151, the chamber 162, and the inlet/outlet 139 and the exterior is subjected to the vacuum inside the shroud while the bag is being filled.

The regulation and control of the admission of pressurized fluid to the boot 116 or 155 is accomplished by means of a regulating valve 193 disposed on the frame member 194. The boot pressure is normally set at 5 p.s.i. to prevent over expansion and boot damage. Generally, the boot retains the mouth of the bag being filled in prior cooperation with the filling spout. FIG. 9 illustrates in section the relationship of a bag B and its mouth M to the filling spout 111 and boot 116 when the bag is properly positioned for filling.

When the bag to be filled is properly positioned within the shroud liner 50 the bag valve mouth thereof will extend into the cavity 110*a* so that upon the expansion of the boot 116 by the introduction of pressurized fluid thereinto the boot 116 will engage with the bag mouth at a point where such mouth is not backed up or supported.

It will be noted that the inlet 139 is provided extending outwardly from the outer tubular member 113 to communicate with the atmospheric exterior of the shroud. By providing such an inlet the high vacuum within the shroud, exterior of the bag being filled, will not tend to draw material from the bag outwardly through the bag mouth M past the boot. Instead, the shroud vacuum and the presence of a low pressure within the bag results in any flow of air past the boot passing into the bag, thus precluding the escape of the powdered material in the shroud or atmosphere surrounding the filling machine.

The filling spout 111 through its inner tubular member 112 is connected to a material supply conduit 142. Material supply hopper 200 is coupled to the outer end of conduit 142 with a material fill valve 201 interposed between the bottom of the hopper and conduit 142.

The degree of compacting achieved by utilization of the principles of the herein disclosed invention may be varied in several ways. First, if a high degree of final product density in the receptacle is desired, a greater number of smaller size increments may be combined to complete the filling of the receptacle than would be used of a lower density product is wanted. Secondly, the degree of vacuum used in the filling operation may be selected to secure the desired compacting or density of the product from the filling operation. Thus, where a high vacuum is employed, the filled receptacle will have a higher density of the fill than where a lower vacuum is used in the filling operation. Also, in connection with the filling machines, the final fill product density may be altered by changing the orifice characteristics of the filling spout.

With regard to the vacuum preferably used in the filling operations, a range of from 4 inches to 28 inches of mercury may be employed depending to some extend on the specific material being handled. With most finely divided powered materials a vacuum of from 22 inches to 25 inches has been found to be ideal. However, as a specific example, in filling with carbon black a vacuum of 18 inches has proved desirable, since at higher vacuums undue compacting and caking of the carbon black material may occur.

OPERATION

The overall operation of the apparatus will be understood with reference to FIGS. 1 through 4, 9, and 12. The mouth of an empty bag, usually in a flattened condition, is placed onto the inflating nozzle 23 and the valve 24 is actuated to inflate the bag. A button is pushed to open the shroud 20, and the inflated bag B is placed into the liner assembly 50 with the filling spout 111 extending into the mouth M of the bag B, and the liner panels are adjusted to conform to the inflated bag size.

The start buttons are pressed to close the shroud door 38. Recycling chamber butterfly valve 69 closes, and the boot 155 inflates to seal on mouth of the bag to be filled. Vacuum valve 66 opens to the vacuum pump, and backwash valve 67 closes. The shroud vacuum valve 64 opens, drawing a vacuum on the shroud. Values 300, 302, and 303 open and atmospheric air enters through open valve 303 into recycling chamber 304, picking up any dust in the chamber, conveying dust and air through open valve 302, conduit 301, through open valve 300 into nozzle tube 140 (FIG. 9) and inflating bag B to its fullest against liners 53 and 55. Air passes through the bag walls and the dust remains inside the bag, completing the bag inflating and recycling operation, and valves 300, 302, and 303 close.

Fill-cycle

Valve 64 remains open and material fill valve 201 opens allowing material to flow into the bag.

Shroud relief

Valves 64 and 201 close. Shroud relief valve 63 opens, creating a squeeze action on the bag, and blows the bag pores clean, through a backwash action on the bag walls.

The fill cycle is on for approximately 3 seconds and the shroud relief cycle is on for approximately ½ second. These cycles alternate until the bag reaches its preset weight.

When the full weight is reached valves 63 and 64 open, drawing any suspended dust in the shroud into the vacuum tank 25. Dust is collected on filter bag 30 which backwahes two (2) seconds after full weight. Valve 64 closes, boot 155 deflates, door 38 opens, and the operator removes the filled bag.

Backwash cycle

Valve 66 closes and valve 67 opens to allow atmospheric air to rush into backwash filter bag 30. Dust is blown off the filter bag and falls down through valve 69 which opens at the same time as 67 opens. Dust falls into recycling chamber 304.

OPERATING SEQUENCE FOR VAPOR BARRIER BAGS

The start buttons are pressed to close the shroud door 38. Recycling chamber butterfly valve 69 closes, and boot 155 inflates to seal on the mouth of the bag being filled. Vacuum valve 66 opens to the vacuum pump, and backwash valve 67 closes. The shroud vacuum valve 64 opens, drawing a vacuum on the shroud, and vacuum valve 305 opens drawing a vacuum inside bag B. Valves 300, 302, and 303 open and atmospheric air enters through open valve 303 into recycling chamber 304, picking up any dust in the chamber, conveying dust and air through open valve 302, conduit 301, through open valve 300 into nozzle inlet tube 139 (FIG. 12) and inflating bag B to its fullest against liners 53 and 55. Air passes through nozzle screen 182 and the dust remains inside the bag, completing the bag inflating and recycling operation, and valves 300, 302, 303 close. Valves 63 and 306 are closed during this cycle.

Fill-cycle

Valves 64 and 305 remain open and material fill valve 201 opens allowing material to flow into the bag. Nozzle relief valve 306 is closed during the fill cycle.

Shroud relief-Nozzle relief

Valves 64 and 201 close. Shroud relief valve 63 opens, creating a squeeze action on the bag. Nozzle relief valve 306 opens allowing atmospheric air to rush into the nozzle, blowing the dust off of screen 182.

The fill cycle is on for approximately 3 seconds and the shroud relief cycle is on for approximately ½ second. These cycles alternate until the bag reaches its preset weight.

When the full weight is reached valves 63 and 64 open, drawing any suspended dust in the shroud into the vacuum tank. Dust is collected on filter bag 30 which backwashes two (2) seconds after full weight. Valve 64 closes, boot 155 deflates, door 38 opens, and the operator removes the filled bag.

Backwash cycle

Valve 66 closes, valve 67 opens to allow atmospheric air to rush into backwash filter bag 30. Dust is blown off the filter bag and falls down through valve 69 which opens at the same time as 67 opens. Dust falls into recycling chamber 304.

While this invention has been described fully and completely with special emphasis upon a preferred embodiment, it should be understood that within the scope of the appended claims the invention may be practiced otherwise than as specifically described herein.

I claim:

1. A bag filling machine for powders and other finely divided material comprising;

a shroud providing a chamber for receiving a bag during the filling thereof and having hingeably connected segments which open to permit introduction and removal of the bags being filled, means for weighing a selected amount of material dispensed into the bag within the shroud, a feed spout having an outlet end for insertion into the mouth of a bag positioned therein for filling, a material supply hopper supplying powders or other finely divided material to said feed spout and the bag filled thereby and a first valve actuatable to control the flow of powder or other finely divided material from the hopper to said feed spout, means for applying a vacuum to the interior of said shroud surrounding the bag supported therein to draw particles of material from said hopper into the bag positioned on said spout, a dust collector connected between said shroud and vacuum-applying means to collect particles of material in the air withdrawn from said shroud during said filling operation, said dust collector including back flushing means and container means receiving particles released from said collector in back flushing, and conduit means connected from said container means for re-cycling particles therefrom into the bag being filled.

2. A bag filling machine according to claim 1 in the which said weighing means comprises a scale mechanism supporting said shroud whereby said mechanism will indicate the weight of material dispensed into the bag within the shroud, said feed spout is carried by said shroud with the outlet end thereof disposed within said shroud for insertion into the mouth of a valve type bag, and a seal element encircles said feed spout adjacent the entrance of said spout into said shroud and is operable to retain the valve bag on said spout within said shroud to preclude escape of material from the bag into said shroud.

3. A bag filling machine according to claim 2 in which said seal element includes an expandable resilient member having an interior space for receiving fluid pressure to expand said member to engage the mouth of the bag being filled.

4. A bag filling machine according to claim 2 in which a liner assembly is adjustably mounted within said shroud and for receiving bags of varying size and shape.

5. A bag filing machine according to claim 2 further comprising a bag inflating horn mounted adjacent said shroud extending forwardly to the side thereof to receive the mouth of a bag for inflation prior to placement into the shroud, said horn being connected to an air pressure supply for inflating a bag and having a control valve for adjustably controlling the inflation pressure.

6. A bag filling machine according to claim 2 further having a fluid driven actuator connected to open and close said shroud segments, and means controlling flow of pressurized fluid to said actuator to open and close said segments.

7. A bag filling machine according to claim 2 further comprising filter means connected between said vacuum-applying means and said shroud, said filter means having a filter bag of fibrous material for capturing particles of material escaping during the filling operation.

8. A bag filling machine according to claim 7 in which said filter means comprises a filter tank having a vacuum valve and a backwash valve mounted thereon and a basket frame for clamping filter bags therein, said vacuum valve connecting said vacuum-applying means to said tank inside the filter bag, and said backwash valve connecting the filter tank with a backwash air supply, an air inlet valve on said tank for allowing air to enter said tank exterior of the filter bag, a butterfly valve coupled with a valve actuator at the bottom of said tank, and an access door on the side of said tank for installing and removing filter bags from said basket frame.

9. A bag filling machine according to claim 2 in which an annular cavity surrounds said feed spout at its entrance to said shroud, and said seal element clamps the mouth of the valve bag between the periphery of said feed spout and the wall of said cavity.

10. A bag filling machine according to claim 2 in which said shroud is slidably mounted on said frame to restrict lateral movement while permitting limited vertical movement as said scale mechanism responds to the filling of said bag.

11. A bag filling machine according to claim 2 in which said scale mechanism comprises a supporting structure, a primary scale beam pivotally connected at an intermediate point to said supporting structure, first means interconnecting one end of said primary scale beam to said supporting structure, second means interconnecting the opposite end of said primary scale beam to said shroud, first electronic means carried by said first interconnecting means for sensing strain therein and converting the same into electrical output signals, second electronic means interconnected with said first electronic means for receiving said output signals and including visual display and means for zeroing the weight of said shroud while filling said bags.

12. A bag filling machine according to claim 11 further including means responsive to said second electronic means to terminate the bag filling operation at a predetermined weight.

13. A bag filling machine according to claim 2 in which said feed spout comprises;

an inner tubular member connected at one end to a material fill conduit, an outer tubular member concentric with said inner tubular member and having seal members at each end forming an annular sealed chamber therearound, said inner tubular member extending beyond said seal assembly having a spout tip threaded thereon, a conduit tube extending from within said sealed chamber at said seal assembly rearwardly through said outer tubular member for connection to a source of pressurized fluid, and an inlet on said inner tubular member, a valve member connected to said inlet for selectively connecting said inner tubular member to atmosphere.

14. A bag filling machine according to claim 13 in which said feed spout further comprises an inlet on the outer tubular member connected to a valve member for selectively connecting said chamber to atmosphere, and said spout tip comprises;

a hollow semi-cylindrical member having a semicylindrical side wall, a cylindrical ring threaded on the end of said inner tubular member, and a semicylindrical ring at the opposing end, said rings being of smaller diameter than the side wall to form a curved surface spaced radially inward of the side wall, said cylindrical ring having an arcuate passageway communicating with said chamber formed between said inner and outer tubular members, a pair of parallel flanges extending outwardly from and longitudinally along the edges of said side wall between said rings and having a series of longitudinally spaced threaded holes, a plurality of semi-circular rods secured in a longitudinally spaced position from the inner surface of said side wall, a wire mesh screen received on the inner surfaces of said rings, said rods, and said flanges, and a retaining bracket having semi-circular ring portions at each end thereof connected by a pair of parallel flat rectangular flanges extending longitudinally therebetween and a series of semi-circular rods secured to the flanges in a longitudinally spaced position in concentric alignment with the rods, said rings and rods adapted to be received within the rings and rods of said semi-cylindrical member for retaining said wire mesh screen thereon.

15. A bag filling machine according to claim 1 in which said dust collector comprises filter means connected between said vacuum-applying means and said shroud, said filter means having a filter bag of fibrous material for capturing particles of material escaping during the filling operation.

16. A bag filling machine according to claim 15 in which said filter means comprises a filter tank having a vacuum valve and a backwash valve mounted thereon and a basket frame for clamping filter bags therein, said vacuum valve connecting said vacuum-applying means to said tank inside the filter bag, said backwash valve being operable to admit air to the interior of said tank to backwash said filter bag, conduit means connecting said spout to said tank, an air inlet valve on said tank connected to said conduit means for allowing air from said shroud to enter said tank exterior of the filter bag, a butterfly valve and actuator therefor at the bottom of said tank above said container, and an access door on the side of said tank for installing and removing filter bags from said basket frame.

17. A bag filling machine according to claim 15 including means to control filling of successive bags in said shroud, and means to discharge powder or other finely divided material backwashed from said filter bag from said container into the material flowing from said hopper into the bag being filled.

18. In a bag filling machine, a shroud having a chamber for receiving a bag during the filling thereof and formed of hingeably connected segments which open for introduction and removal of the bags being filled, a scale mechanism supporting said shroud and having means responsive to a predetermined filling of the bag being filled to terminate the filling operation, a feed spout in the upper end of said shroud having a seal element engageable with the mouth of the bag being filled to retain same on said spout, a material supply hopper, a material supply conduit interconnecting said feed spout and said hopper and having a material valve interposed therein controlling flow of material therethrough, a vent valve operable to control admission of a gas through said feed spout and into the bag to open the bag retained on said spout, a vacuum valve for coupling the interior of said shroud with a source of vacuum, a relief valve for connecting the interior of said shroud with atmospheric pressure, pressure responsive means connected to open said material valve when the pressure within said shroud reaches a predetermined vacuum, a dust collector connected between said shroud and said vacuum-applying means to collect particles of material in the air withdrawn from said shroud during said filling operation, said dust collector including back flushing means and container means receiving particles released from said collector in back flushing, and conduit means connected from said container means for re-cycling particles therefrom into the bag being filled.

19. A method of filling a receptacle with finely divided particulate material which comprises;

admitting gas into the interior of the receptacle to be filled to expand same to a partially opened condition, creating a vacuum within the receptacle to be filled by withdrawal of air therefrom, admitting particulate material into the interior of said receptacle, terminating the admission of particulate material after only an increment of the quantity of particulate material required to fill the receptacle has been dispensed into the receptacle, momentarily diminishing the vacuum within the receptacle to cause an instantaneous reverse flow of air back into the receptacle while continuously maintaining a substantial sub-atmospheric pressure within the receptacle to withdraw air from between the material particles to compact the particulate material, repeating the above recited steps until the increments of particulate material fill the receptacle to the desired degree, circulating air withdrawn when creating said vacuum to a dust collector to collect particulate matter therein, and periodically backwashing said dust collector and circulating particulate matter from said dust collector to the bag being filled.

20. A method of filling a receptacle with finely divided particulate material which comprises;

creating a vacuum within the receptacle to be filled by withdrawing air therefrom, admitting particulate material into the interior of said receptacle under the effect of the vacuum within the receptacle, terminating the flow of particulate material after only an increment of the quantity of particulate material required to fill the receptacle has been dispensed into the receptacle, momentarily diminishing the vacuum within the receptacle to cause an instantaneous reverse flow of air back into the receptacle while continuously maintaining a substantial sub-atmospheric pressure within the receptacle to withdraw air from between the material particles to compact the particulate material, repeating the above recited steps until the increments of particulate material fill the receptacle to the desired degree, circulating air withdrawn when creating said vacuum to a dust collector to collect particulate matter therein, and periodically backwashing said dust collector and circulating particulate matter from said dust collector to the bag being filled.

21. A method of filling a collapsible receptacle with finely divided particulate material which comprises;

creating a vacuum within and surrounding the receptacle to be filled by withdrawal of air therefrom, admitting gaseous fluid into the interior of the receptacle to expand same to its fully opened condition, discharging an increment of particulate material into the receptacle while the vacuum is maintained within the receptacle, terminating the flow of particulate material into the receptacle, momentarily diminishing the vacuum within the receptacle to cause an instantaneous reverse flow of air back into the receptacle while continuously maintaining a substantial sub-atmospheric pressure within the receptacle to withdraw air from between the material particles to compact the particulate material, and repeating the third, fourth and fifth steps when a predetermined weight of particulate material has been dispensed into the receptacle, circulating air withdrawn when creating said vacuum to a dust collector to collect particulate matter therein, and periodically backwashing said dust collector and circulating particulate matter from said dust collector to the bag being filled.

* * * * *